US005971748A

United States Patent [19]

Rogelet

[11] Patent Number: 5,971,748

[45] Date of Patent: Oct. 26, 1999

[54] GAS SAFETY LIGHTER COMPRISING A PYROPHORIC FLINT AND SPARK WHEEL IGNITION SYSTEM

[75] Inventor: Thierry Rogelet, Lyons, France

[73] Assignee: Cricket, Rillieux la Pape, France

[21] Appl. No.: 08/856,804

[22] Filed: May 15, 1997

[30] Foreign Application Priority Data

Jun. 6, 1996 [FR] France ..... 96 07248

[51] Int. Cl.[6] ..... F23D 11/36

[52] U.S. Cl. ..... 431/153; 431/276; 431/254; 431/277

[58] Field of Search ..... 431/153, 276, 431/254, 277

[56] References Cited

U.S. PATENT DOCUMENTS

| | | | |
|---|---|---|---|
| 5,002,482 | 3/1991 | Fairbanks et al. . | |
| 5,125,829 | 6/1992 | McDonough et al. . | |
| 5,165,885 | 11/1992 | Iwahori . | |
| 5,197,870 | 3/1993 | Yang . | |
| 5,271,731 | 12/1993 | Hsin-Chung . | |
| 5,427,523 | 6/1995 | Yiu | 431/153 |
| 5,634,787 | 6/1997 | Frigiere | 431/153 |
| 5,676,537 | 10/1997 | Fang | 431/153 |

FOREIGN PATENT DOCUMENTS

| | | |
|---|---|---|
| WO 93/17282 | 9/1993 | WIPO . |
| WO 95/04247 | 2/1995 | WIPO . |

*Primary Examiner*—Larry Jones
*Attorney, Agent, or Firm*—Oliff & Berridge, PLC

[57] ABSTRACT

The invention relates to a spark wheel type gas lighter comprising a lighter body, a reservoir, a valve permitting gas to leave the reservoir, an ignition system comprising a pyrophoric flint co-operating with a spark wheel and a spring maintaining the flint against the spark wheel, a lever pivotally mounted on an axis essentially parallel to the axis of rotation of the spark wheel and co-operating with the valve and the axis of the lever is mounted movably with respect to the body of the lighter between an active position permitting the operation of the valve mounted on the reservoir and a rest position in which action on the lever does not permit operation of the valve, the spark wheel can be displaced with respect to the body of the lighter, and operate the lever in its movement, and elastic means act on the lever and/or on the spark wheel to return them to a position of rest in which the lever does not act on the valve. The body of the lighter may comprise two oblong openings, each receiving a spindle of the pivoting lever which are 'V' shaped, the point of the 'V' being located next to the spark wheel and in that the spindles of the pivoting lever are located at the level of the point of the 'V' in the rest position of the lever, and at the level of the end of the branch of the 'V' located next to the valve in the active position of the lever. The pivoting lever comprises an abutting face which acts against a counter-abutting face integral with the body of the lighter when the lever is in its rest position, thus preventing pivoting of the lever, and does not abut in the active position of the lever, thus permitting pivoting of the lever and operation of the valve.

7 Claims, 6 Drawing Sheets

GAS SAFETY LIGHTER COMPRISING A PYROPHORIC FLINT AND SPARK WHEEL IGNITION SYSTEM

Figure 1:
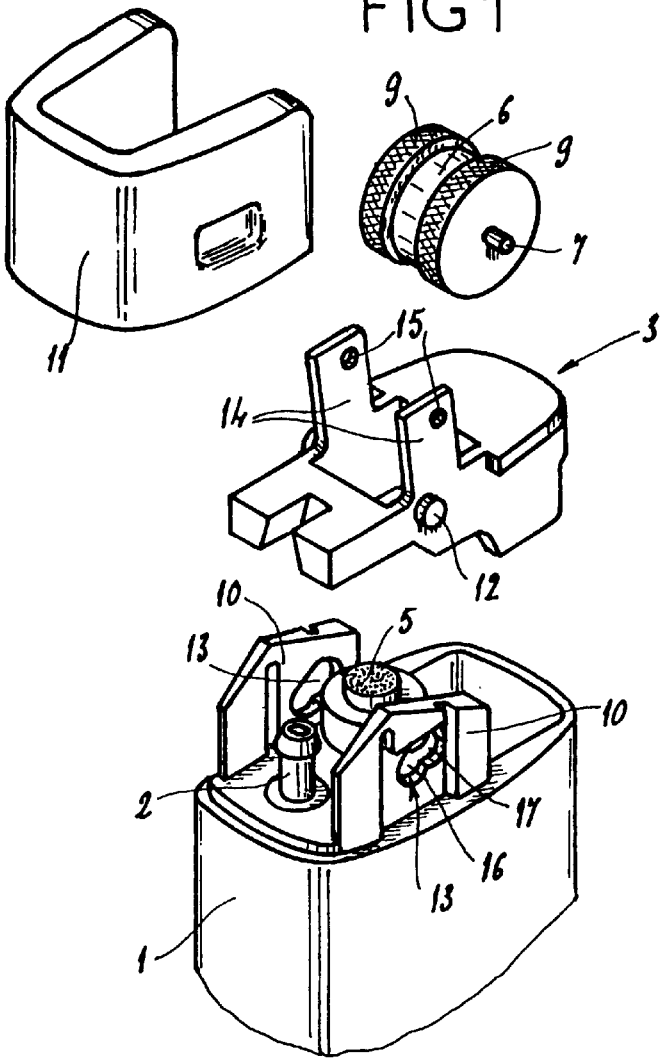

The present invention relates to a gas safety lighter comprising a pyrophoric flint and spark wheel ignition system.

Gas lighters with pyrophoric flint and spark wheel ignition systems generally comprise a reservoir containing liquefied petroleum gas, a valve mounted on the reservoir permitting gas to leave the reservoir, an opening and closing system for the release of gas operated by a lever, a system of regulation of the release of gas as well as the ignition system. In a known way, the ignition system comprises a pyrophoric flint co-operating with a spark wheel and frequently a protective cap. The spark wheel is mounted on an axis between two thumb wheels.

When the spark wheel, being in contact with the flint, is rotated by operation of the thumb wheels by a digit of the user, a spray of sparks is created and is followed by the action of the same digit against the gas opening lever which releases a quantity of gas. The spray of sparks ignites the gas, producing a flame which forms above the cap.

Such a system requires a positive action on the part of the user to produce and maintain a flame and requires two independent movements one after the other—rotation of the spark wheel and action on the gas opening lever—to produce a flame.

However, it is desirable to increase the difficulty of operating such lighters so that children younger than five years old are not able to produce a flame with such lighters.

Lighters already exist providing a supplementary difficulty which must be overcome to produce a flame and several patents or patent applications describe such lighters. For example, U.S. Pat. Nos. 5,125,829, 5,002,482 or international patent applications WO 93/17282, WO 95/04247.

The lighters described in these documents comprise, compared to conventional lighters, a supplementary device making access to the thumb wheels of the spark wheel more difficult, or by blocking movement of the gas opening lever.

In this way, these lighters comprise a complex structure involving an increased cost of manufacture. Furthermore, the use of some of these lighters is complicated and requires a particular method of use. Even adults can find several difficulties in the operation of such lighters and need preliminary instructions.

Besides, with certain of these known safety lighters comprising a blocking device for the gas opening lever, the gas opening lever can be unintentionally unblocked when it rests in the user's pocket, for example, and it stays in this unblocked position until the lever is operated. Quite a long length of time could elapse between the unblocking of the lever and the use of the lighter requiring operation of the lever. During this time, the lighter could fall into the hands of a child. The blocking of the lever being unoperated, the child would have no difficulty in igniting a flame with this lighter.

The objective of the present invention is to provide a lighter which is easily usable by an adult but difficult to use by a child and in particular a child less than five years old.

Another objective of the invention is provide a reliable security system, which is inviolable and constant in operation, without preliminary intervention.

Finally an objective of the present invention is to provide a security ignition system in which the unblocking action is effected in the same place as the ignition action.

To this end, the invention proposes a gas lighter of the type comprising a lighter body, a reservoir for containing a liquefied petroleum gas, a valve mounted on the reservoir permitting gas to leave the reservoir, an ignition system comprising a pyrophoric flint co-operating with a spark wheel and a spring maintaining the flint against the spark wheel, the spark wheel being rotatably operated by at least one thumb wheel mounted co-axially with the spark wheel, and also a system of opening and closing for the release of gas comprising a lever pivotally mounted on an axis essentially parallel to the axis of rotation of the spark wheel and co-operating with the valve mounted on the reservoir.

According to the invention the axis of the lever is mounted movably with respect to the body of the lighter between an active position permitting the operation of the valve mounted on the reservoir and a rest position in which action on the lever does not permit operation of the valve; the spark wheel is mounted in such a way that it can be displaced with respect to the body of the lighter, and that it operates the lever in its movement, and elastic means act on the lever and/or on the spark wheel to return them to a position of rest in which the lever does not act on the valve.

Thus, to operate a lighter according to the invention, it is necessary to bring the lever in an active position in which it can operate on the valve of the lighter, then to rotate the spark wheel in a conventional manner for a lighter of this type. It is therefore necessary to combine three movements to ignite the lighter: a first movement to displace the lever, a second to rotate the spark wheel and a third movement to press down the lever to release the gas. Preferably, the displacement movement of the lever is made towards the front of the lighter, that is, towards the valve. In effect, the natural tendency for the user, particularly a child, is to exercise a force towards the base, in the direction of the body of the lighter, and also towards the rear of the lighter. Thus, the movement required to operate the lighter goes against the natural tendency of the user, which is favourable from the point of view of security. However, this action does not pose any problem for an adult who knows that the lighter is provided with a security device.

The elastic means for returning to the position of rest are notably the elastic means present in conventional lighters, namely a spring for biasing the flint against the spark wheel, a spring for returning the lever to its rest position and finally a spring for closing the gas exit valve.

To operate the lighter it is only necessary to act on the spark wheel, or more precisely, its thumb wheels, which have an action on the lever. The action of unblocking is effected therefore in the same place as the action of ignition of the flame.

No part or assembly of parts fulfilling the function of the security device can be retracted. The device is therefore inviolable.

The lever can be guided with respect to the body of the lighter in several ways. It could, for example, be provided with on each side, a groove which could slide between two rails along a course limited by two abutments. Preferably in this embodiment the lever comprises lateral spindles defining its pivoting axis and the body of the lighter comprises two oblong openings, each destined to receive a spindle of the pivoting lever. In this last embodiment, the oblong openings are preferably in the form of a 'V', the point of the 'V' is situated on the side of the spark wheel and the spindles of the pivoting lever are situated at the level of the point of the 'V' in the rest position of the lever and at the level of the end of the branch of the 'V' located at the side of the valve in the active position of the lever.

Three positions are therefore defined: a first stable rest position, an unstable position in which it is not possible to operate the valve, and finally an unstable position permitting ignition of the flame. When the lever is in the position preventing ignition of the lighter it must return to its stable position of rest to be able to be ignited.

There are several ways to prevent, in this given position of the lever, the operation of the valve. The invention proposes two alternative embodiments.

In a first alternative, the pivoting lever comprises an abutting face which lies alongside a counter-abutting face integral with the body of the lighter, when the lever is in its rest position, thus preventing the pivoting of the lever, and which is in a non-effective position with respect to the counter-abutting face in the active position of the lever, thus permitting pivoting of the lever and operation of the valve.

In a second alternative, the valve comprises a shoulder on which the lever acts to open the valve letting the gas escape from the reservoir and on the side of the valve the lever comprises two openings of different diameters, the opening with the largest diameter is situated in front of the shoulder when the lever is in the rest position and being such that the shoulder passes through this opening, and the opening with the smaller diameter is situated in front of the shoulder when the lever is in the active position and being such that the shoulder is not able to pass through this small opening.

It is also possible to have a fork, being part of the lever and passing under the shoulder where the separation between the prongs varies. Thus, in a first position, the shoulder is situated with respect to the fork such that when it pivots the lever does not operate against the shoulder, and in a second position the shoulder is situated with respect to the fork such that the shoulder is operated by the pivoting lever.

The assembly of the spark wheel can be achieved in different ways.

In a first way, the pivoting lever comprises two wings essentially parallel to the axis of the body of the lighter, between which the spark wheel is mounted. The spark wheel does not possess any degree of freedom with respect to the lever, (rotating about the axis of the spark wheel).

In another way, the ignition system comprises a pyrophoric flint and a spark wheel mounted in a sheath, comprising a tubular part surrounding the flint, and two wings between which is mounted the spark wheel at one of the ends of the tubular part; the sheath is placed in a housing arranged in the body of the lighter in such a way that the sheath can pivot in the interior of this housing, and the sheath passes through an opening formed in the pivoting lever in such a way that the ignition system moves in its housing, this movement being transmitted to the pivoting lever. In this configuration the spark wheel is mounted in an system independent of the lever.

In any event, the invention comprises several embodiments which are described as follows with reference to the attached drawings representing non-limiting examples of the gas lighter according to the invention.

Figure 2:
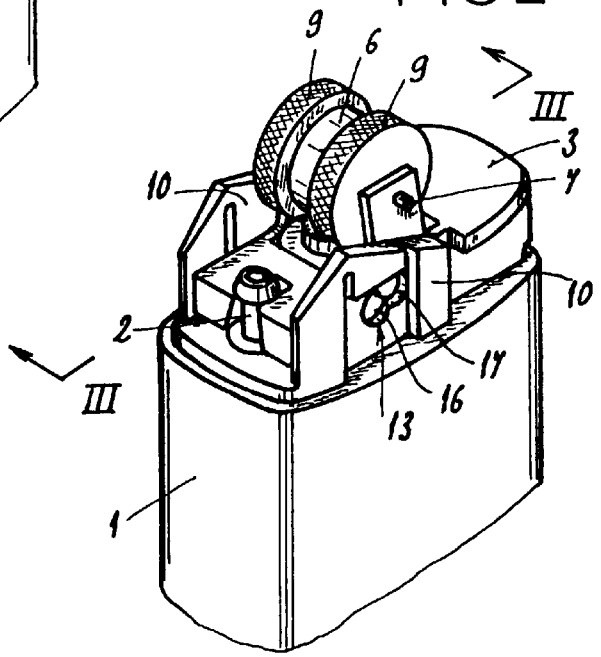
Figure 4:
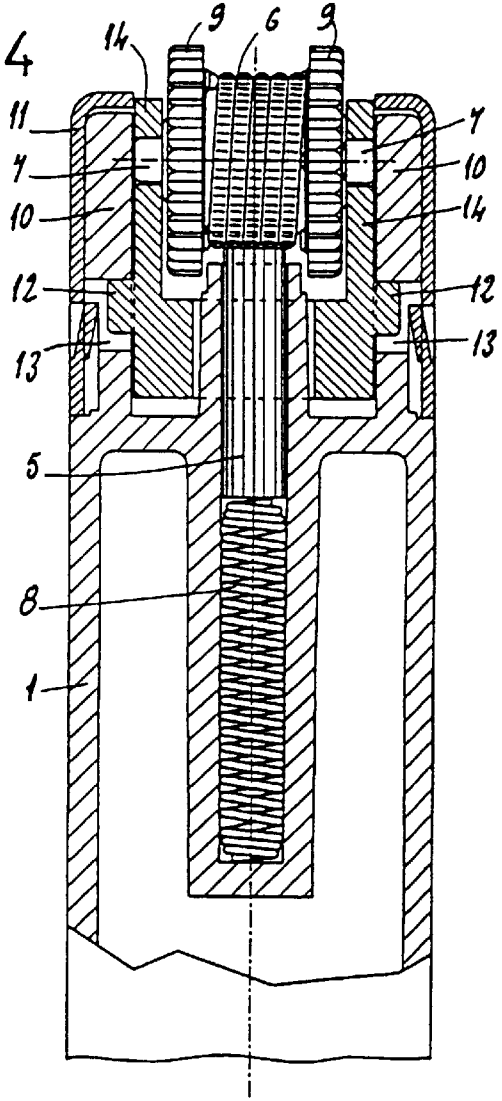
Figure 3:
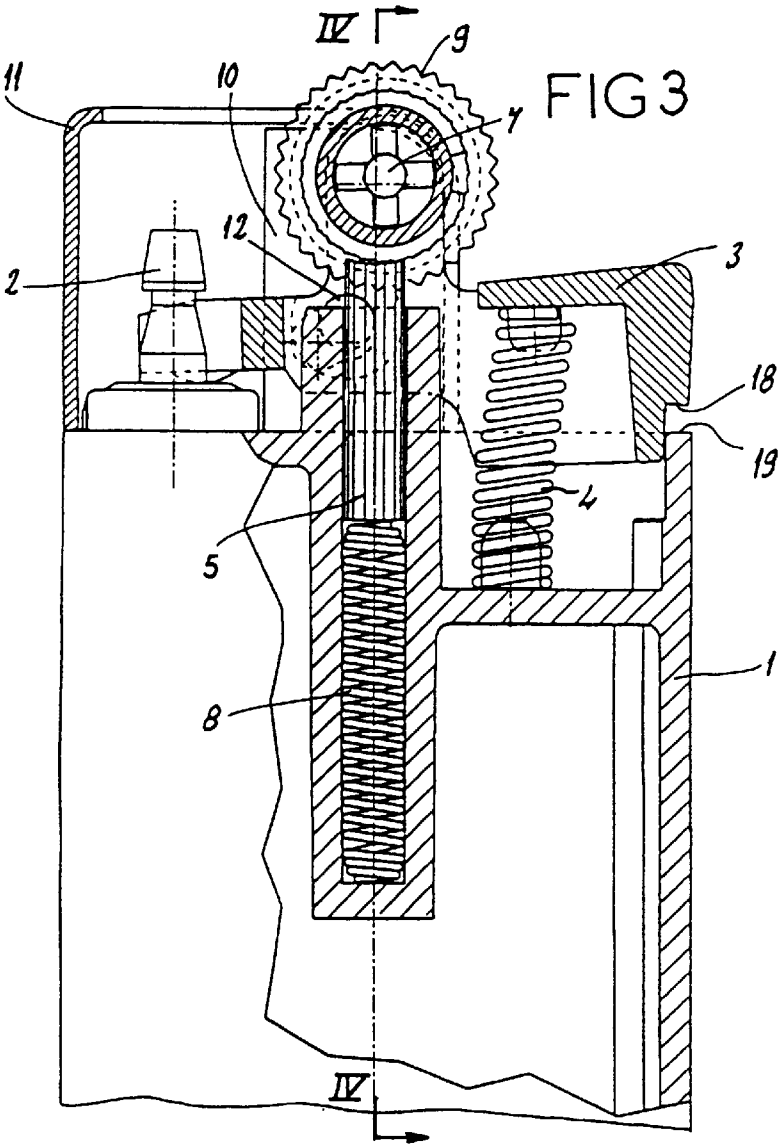
Figure 6:
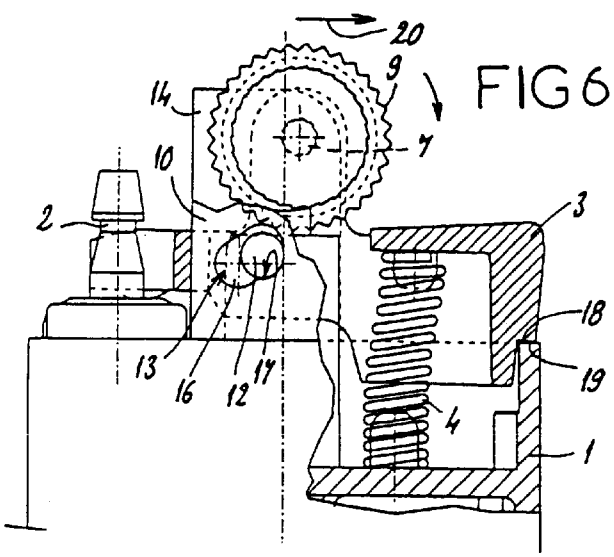
Figure 8:
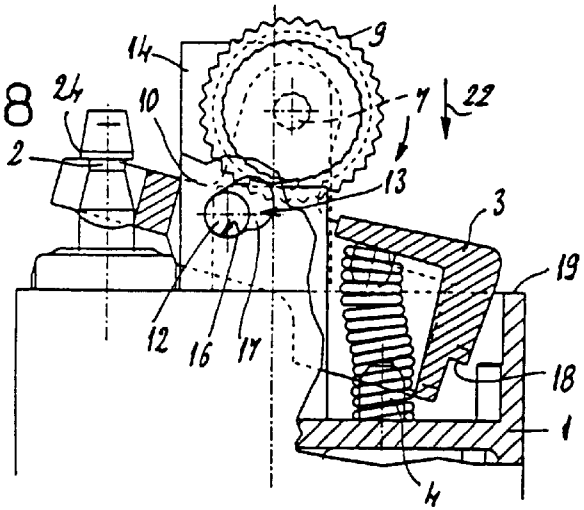
Figure 9:
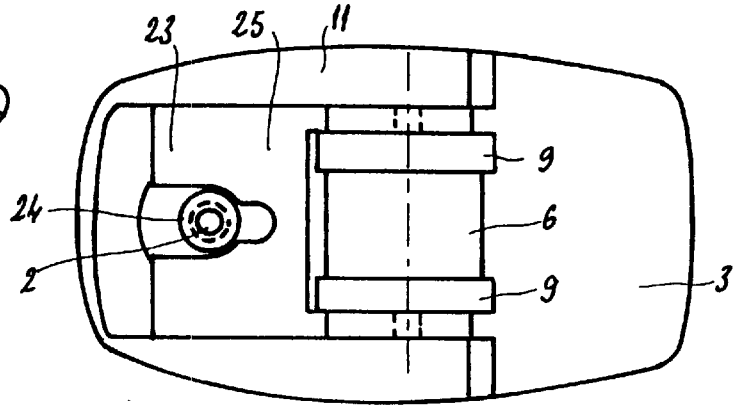
Figure 10:
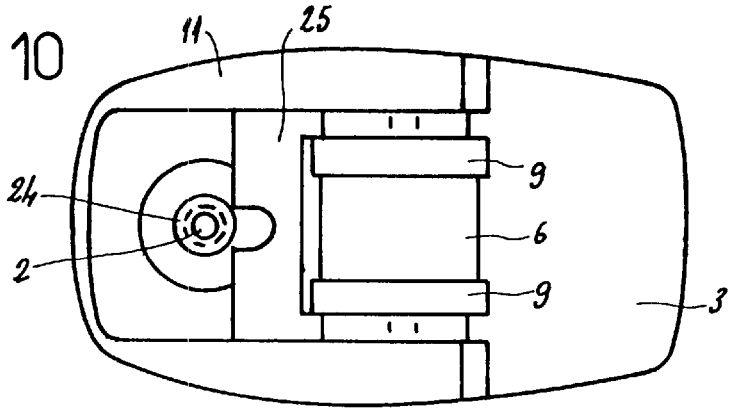
Figure 11:
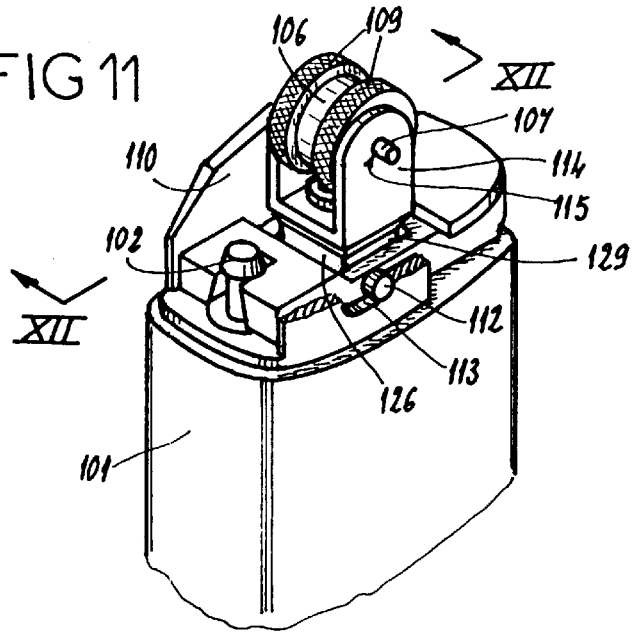
Figure 13:
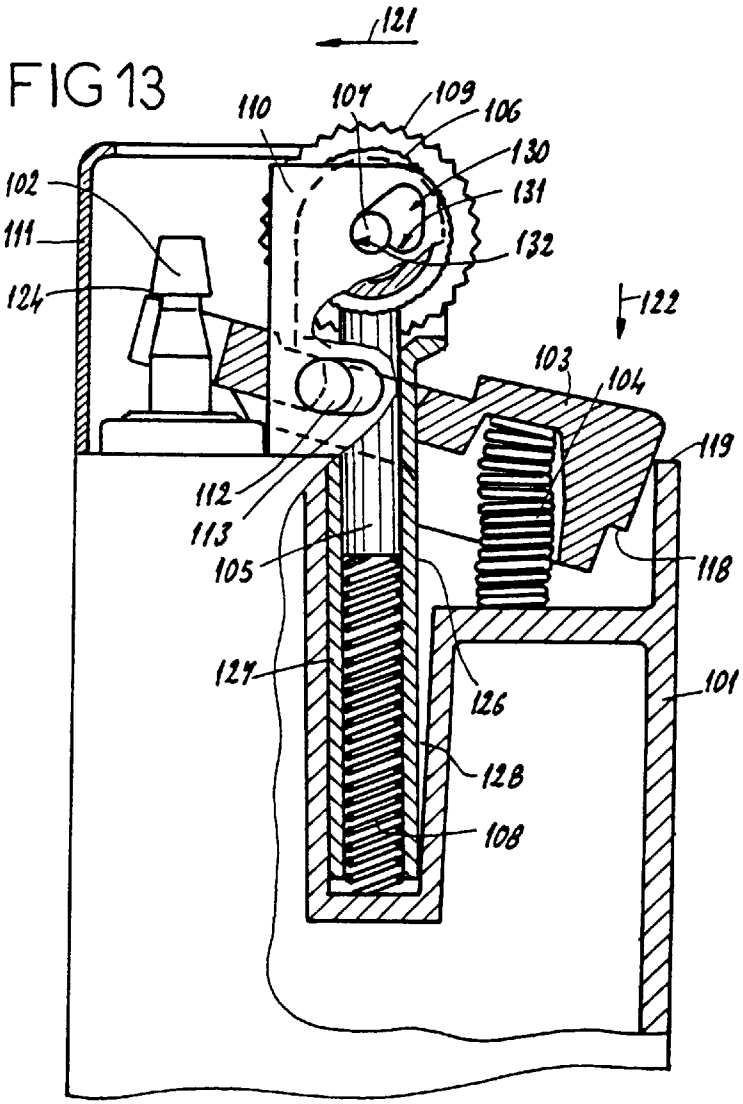
Figure 12:
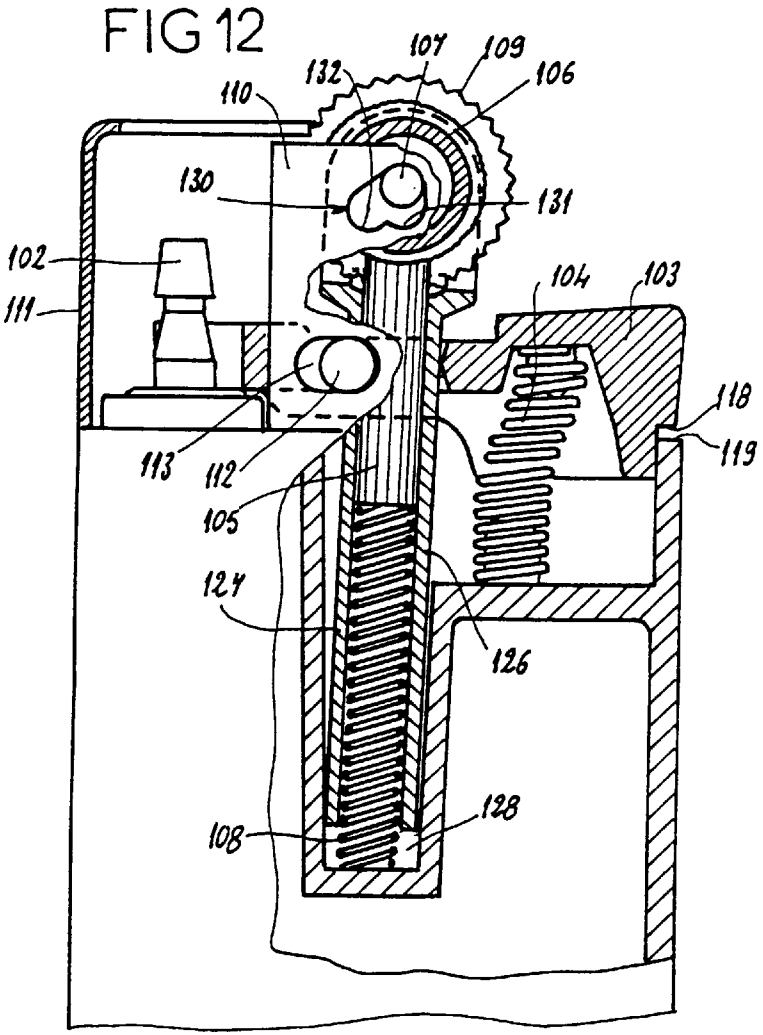
Figure 14:
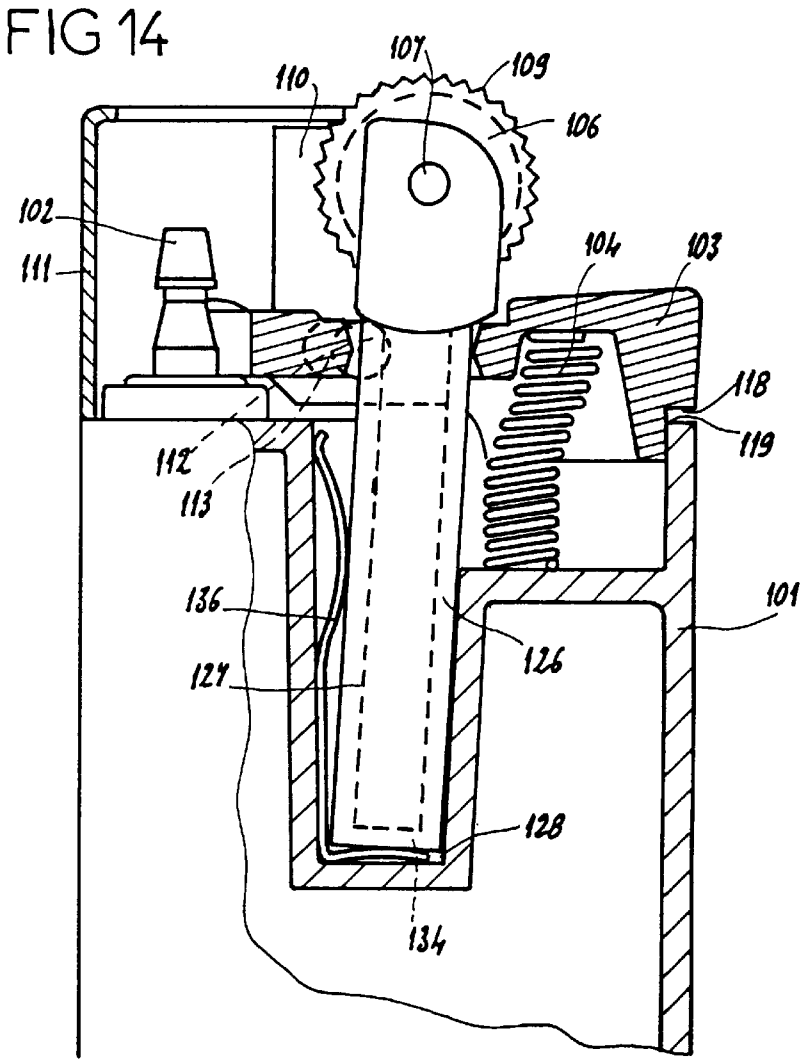
Figure 15:
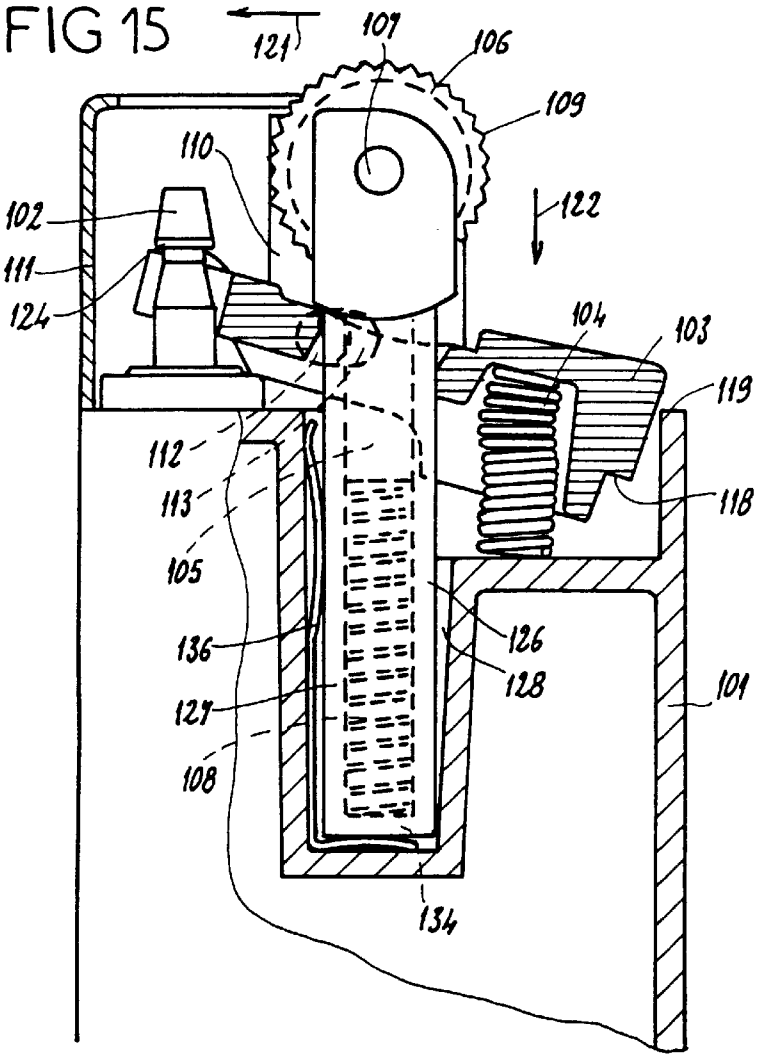

FIG. 1 is an exploded perspective view of a first embodiment of a lighter according to the invention, FIG. 2 is a perspective view in the assembled position of the lighter of FIG. 1, FIG. 3 is a cross-sectional view along the line III—III of FIG. 2 and in enlarged scale of the ignition system in the rest position, FIG. 4 is a cross-section through the line IV—IV in FIG. 3, FIGS. 5 to 8 are corresponding views of FIG. 3, showing different positions of the lever of the lighter, FIGS. 9 and 10 are views from above of two alternative embodiments of a lighter like the one shown in FIGS. 1 to 8, FIG. 11 is a perspective view of a fourth embodiment of a lighter according to the invention, FIG. 12 is a cross-section along the line XII—XII of FIG. 11 in larger scale, FIG. 13 is a cross-section similar to that of FIG. 12 in a different operational position, FIG. 14 is a cross-sectional view along the line XIII—XIII of FIG. 11 in enlarged scale showing an alternative embodiment to that in FIGS. 12 and 13, and FIG. 15 is a similar cross-sectional view to that in FIG. 14 in a different operational position.

In FIGS. 3 and 4 in particular, one can see a gas lighter comprising, in a known way, a body 1 comprising a reservoir for containing liquefied petroleum gas.

On its upper part the reservoir is provided with a valve 2 which permits gas to escape when the valve 2 is in an open position. A lever 3 operates the opening and closing of the valve 2. A spring 4 acts on the lever 3 such that in the rest position the valve 2 is closed. The part of the lever 3 situated opposite the valve 2 is operated by a user when the user wishes to release gas from the reservoir to form a flame, for example. Next to the valve 2 the lever is in the form of a fork with two prongs, the distance between the prongs being essentially constant and the valve 2 being located between the two prongs of this fork.

The lighter also comprises an ignition system permitting ignition of the gas exiting the valve 2. This system comprises a pyrophoric flint or lighter flint 5 and a spark wheel 6. The latter is mounted on an axis 7 about which it can rotate. It is in the form of a cylinder and its peripheral surface is indented.

The lighter flint 5 acts radially on the spark wheel 6. A spring 8 maintains the flint 5 against the spark wheel 6. Thus, when the spark wheel rotates about its axis 7, sparks are produced which can ignite the gas escaping from the valve 2.

Two thumb wheels 9 are arranged co-axially with respect to the spark wheel 6, one on each side thereof. The thumb wheels 9 can not only be formed in a single piece with the spark wheel 6, but also can be formed from distinct components fixed to the spark wheel 6.

The thumb wheels 9 are circular discs having a peripheral surface in the form of an indented edge. Thus, the coefficient of friction between the digit of the user and these thumb wheels 9 is increased.

The body of the reservoir comprises, next to the spark wheel 6 and the lever 3, two plates 10 serving to fix the lever 3 and a protective cap 11. The lever 3 is situated between these two fixing plates 10, which are formed in a single moulded piece with the body 1 of the lighter.

The lever 3 comprises, in its middle part, two lateral cylindrical circular spindles 12, thus defining a pivoting axis about which the lever 3 can pivot. The spindles 12 are each lodged in an opening 13, formed in a fixing plate 10. Each opening 13 is in the form of an approximate 'V' shape, thereby defining three corresponding positions for the spindle: two positions in which the spindle is located at the end of a branch of the 'V', and the third position when it is located in the point of the 'V'. This latter position is located next to the spark wheel 6.

The lever 3 equally comprises, essentially above each spindle 12, a bracket 14, essentially parallel to the plates 10 of the body of the lighter and extending in the same direction as these plates 10. These brackets 14 are each provided with an opening 15 serving to provide the axis 7 of the spark wheel and the thumb wheels. The spark wheel 6 can turn freely in these supports 15, but cannot be displaced, therefrom.

The first branch of the 'V', which is situated next to the valve 2, is rounded at its end 16. The radius of curvature is sufficiently large to receive the corresponding spindle 12 and permit its rotation when it is located in this branch. It is sufficient that this radius of curvature is greater than the external diameter of the spindle 12.

The second branch 17 of the 'V' opposite the valve 2, and next to the end of the lever 3 which receives the digit of the user, is also rounded in such a way that it can also receive the corresponding spindle 12.

The base of the 'V' is such that it can receive the spindle 12 in all its corresponding positions. At rest, when no action is exercised on the lever 3 or on the thumb wheels 9, the spindle 12 is located in the base of the 'V' because the flint 5, under the action of the spring 8 and through the intermediate spark wheel 6, pushes the spindles 12 in this position, the base of the 'V' being opposite the housing of the spring 8.

The lever 3 comprises, on its side receiving the finger of the user, under the face receiving the finger, an abutting face 18, provided in the form of a shoulder. The body of the lighter 1 comprises with respect to this, a counter-abutting face 19 formed by the top of the moulding of the body 1. When the spindles 12 of the lever 3 are located at the base of the 'V' of the opening 13, that is to say when the lever is in the rest position, the abutting face 18 is located alongside the counter-abutting face 19.

Figure 5:
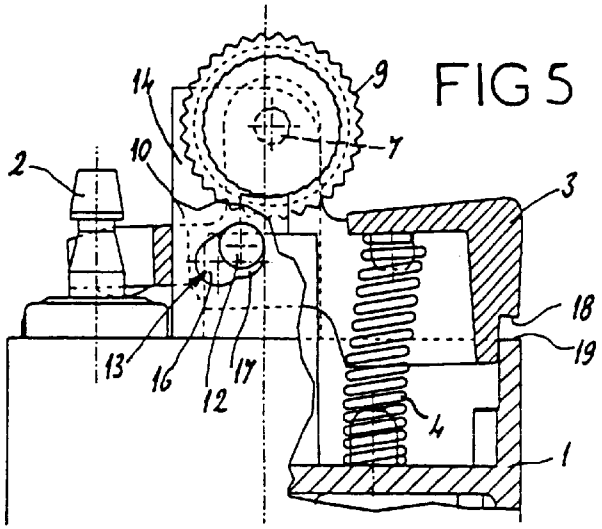

FIGS. 5 to 8 illustrate the operation of the lighter. From the start position, as shown in FIG. 5, the lever 3 is in a position of rest. It does not act on the valve 2. The tendency of a user, and in particular a child, is to exercise an action on the thumb wheels 9 which tends to bring these towards the lever which needs to be pressed in order to release the gas. Now, when a user acts on the thumb wheels 9 to turn the spark wheel 6, simultaneously exerting a light force towards the rear of the lighter, in the direction indicated by the arrow 20, the spindles 12 engage in the branch 17 of the corresponding opening 13 and when the digit of the user, at the end of its course, presses on the lever 3, the abutting face 18 acts against the counter-abutting face 19, thus preventing any action on the valve 2.

Figure 7:
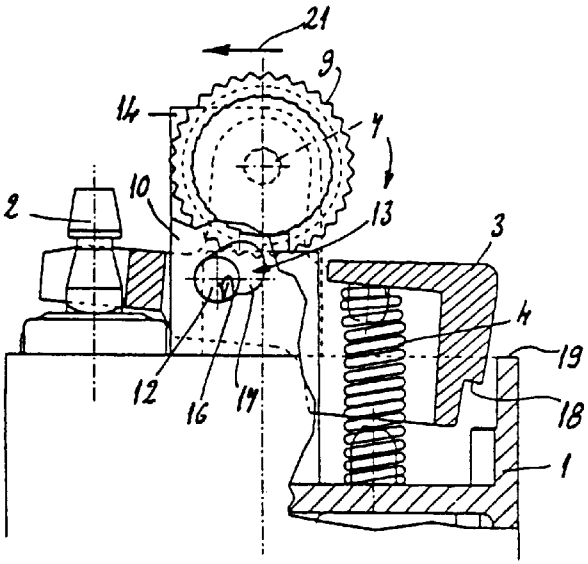

On the contrary, when the digit of the user acts on the thumb wheels 9 in order to turn the spark wheel 6 to produce sparks exercising a force towards the front of the lighter, as indicated in FIG. 7 by the arrow 21, each spindle is displaced towards the branch 16 of the corresponding opening 13, that is to say towards the valve 2, and the abutting face 18 is no longer located along side the counter-abutting face 19. Thus, it becomes possible to act on the lever 3, exercising a force as shown in FIG. 8 with the arrow 22, to liberate the gas contained in the reservoir.

FIG. 9 of the drawings shows a view from above of an alternative embodiment of the lighter described with reference to FIGS. 1 to 8. Only the lever 3 in this embodiment differs from the preceding description. This new lever comprises, as did the preceding one, the brackets 14 to receive the spark wheel 6 and its thumb wheels 9. However, it does not comprise an abutting face 18.

In the view from above the lever 3 has at its front side, that is to say the side of the valve 2, a fork shaped section. The lever 3 passes in the region of the fork under a shoulder 24 of the valve 2 against which the lever acts on the valve 2 in the direction of opening of the valve. FIG. 8 shows how the lever 3 acts on the valve 2. The separation between the branches of the fork is not constant. In the front part 23 of the fork the separation of the branches is relatively large. It is larger in diameter than the shoulder 24. In the rear part 25 of the fork, this separation is less than the diameter of the shoulder 24.

When the lever is in the rest position, or even when its spindles 12 are located in the rear inactive branch 17 of the opening piece 13, the shoulder 24 is located next to the front part 23 of the fork, that is to say, the part or the separation which is larger. If in this position the user acts as indicated by the arrow 22 in FIG. 8, the shoulder passes between the branches of the lever and thus it cannot act on the valve 2. On the contrary, if the spindles of the lever 3 are located in the active rear branch 16 of the openings 13, the shoulder 24 is located next to the rear part 25 of the fork. An action on the lever 3 is thus transmitted to the shoulder 24, and the valve 2.

FIG. 10 shows a small variation of the embodiment of FIG. 9. Here, the front part of the fork is removed. The lever is shortened. It is only positioned next to the shoulder 24 when the lever is in the advanced position, that is to say, when the spindles 12 are each located in an active rear branch 16 of the corresponding opening 13.

FIGS. 11 to 13 show a further embodiment of a lighter according to the invention. In these figures the elements corresponding to the elements described with reference to the previous figures carry the same reference numbers increased by 100.

These figures show a lighter comprising a lighter body 101 forming a reservoir for containing liquefied petroleum gas. On its upper part, the reservoir is provided with a valve 102, comprising a shoulder 124. A lever 103 operates the opening and closing of the valve 102 and acts on the shoulder 124. A spring 104 acts on the lever 103 to return it to the rest position.

This lighter also comprises an ignition system for igniting the gas exiting from the valve 102. This system comprises a flint 105 and a spark wheel 106 mounted between two thumb wheels 109 on an axis 107. A spring 108 acts on the flint 105 to permanently press the flint 105 against the spark wheel 106.

The ignition system is mounted in a sheath 126. This sheath 126 comprises a lower part 127 in the form of a cylindrical tube with a square cross-section, in which the spring 108 and the flint 105 are located. Next to the flint 105 and the spark wheel 106 the sheath 126, in its upper part, comprises two brackets 114. These brackets 114 extend parallel to the axis of the lower part 127 of the sheath on each side of it and extending therefrom. Each bracket 114 comprises an opening 115 for accommodating the axis 107.

The sheath 126 is located in a housing 128 provided in the body 101 of the lighter. The spring 108 can, for example, act against the base of the housing 128 as shown in the drawing. The housing 128 is quite large to permit the sheath 126 to take up different positions as shown in FIGS. 12 and 13.

The lever 103 comprises two circular cylindrical shaped spindles 112, extending transversely from each side of the lever in the middle area thereof. These spindles are each located in an opening 113 arranged in the plate 110 of the body 101, in the same way as the plate 10 described above. The plates 110 and brackets 114 are parallel to each other and one finds for each plate 110 a corresponding bracket 114. The opening 113 is in a different shape to the opening 13 described above, but it fulfils the same function of guiding the lever. Here, the opening 113 is an oblong hole, essentially parallel to the plane of the lever 103 in the rest position.

The lever 103 comprises in its central area, approximately between the spindles 112, a square opening 129 for receiving the sheath 126. The opening 129 is arranged such that the lever 103 is not constrained in its pivoting movement by the sheath 126 and that the movements of the sheath 126 towards the front and the rear of the lighter are transmitted directly to the lever 103.

One can also find on the lever 103 an abutting face 118 co-operating with a counter-abutting face 119 as described with reference to FIGS. 1 to 8.

The axis 107 of the spark wheel and of the thumb wheels extends beyond the brackets 114 of the sheath and an opening 130 in the form of an inverse 'V' is provided in each plate 110 for receiving the end of the axis 107. The base of the 'V' is situated towards the top, that is to say, next to the spark wheel 106, whereas the ends of the branches of the 'V' are orientated towards the body 101 of the lighter.

In the rest position, each end of the axis 107 is located at the level of the base of the opening 130 as shown in FIG. 12.

From this rest position, if a force is exerted towards the rear of the lighter when the user rotates the spark wheel 106 with the assistance of the thumb wheels 109, the axis 107 becomes lodged in the rear branch 131 of the opening 130. The abutting face 118 is thus against the counter-abutting face 119 and the lever 103 cannot act on the valve 102.

Thus, in order to operate the lighter, it is necessary to return to the rest position, returning one's digit to the thumb wheels 109, then exerting a force towards the front of the lighter before rotating the spark wheel 106, such that the ends of the axis 107 engage in the forward branch 132 of each opening 130. The sheath 126 correspondingly moves from its rest position away from the valve 3, as shown in FIG. 12, to its active position closer to the valve 3 as shown in FIG. 13, the cylindrical shaped spindles 112 moving from one end of the opening 113 to the other. The abutting face 118 is thus no longer against the counter-abutting face 119, and it is possible to operate the lever 103 to act on the valve 102 by exercising a force in the direction of arrow 122 as indicated in FIG. 13.

FIGS. 14 and 15 show a variation of the embodiment of FIGS. 12 and 13. FIG. 11 also corresponds to this variation. The differences in this variation of the embodiment, essentially concern the sheath 126. The description of the body of the lighter and of the lever 103 with in particular the housing 128, the abutment 118 and the counter-abutment 119 remain unchanged.

The sheath 126 is located in the housing 128. Contrary to the sheath of FIGS. 12 and 13, it comprises, in a preferred form, a base wall 134 against which the spring 108 acts. Thus, the sheath 126 comprises, independently from the rest of the elements of the lighter, an ignition system comprising the flint 105, the spark wheel 106 and the spring 108.

A leaf spring 136 is located in the housing 128 and acts on the sheath 126. It acts in such a way that the lever 103, by means of the sheath 126, is biased towards its rest position, in which the abutment 118 is located against the counter-abutment 119. Thus, the lever 103 is maintained in the locked position.

As for the lighter shown in FIGS. 12 and 13, to light the lighter it is necessary to advance the spark wheel 106 towards the front in order to, in this position, rotate the spark wheel 106 and act on the lever 103.

In all the embodiments described above, the mode of operation of the lighter is very close to that of a standard lighter. Once the spark wheel and thumb wheel assembly is pre-positioned, the mode of operation is identical to that of a standard lighter.

To avoid all loss of gas contained in the reservoir, other than that in the desired position, the valve can be provided with an element, not shown, to retard the opening of the reservoir, such as, for example, a compensation spring. An auto-closing system could also be more convenient.

This safety system is constantly active. The user uses this lighter according to the invention as a standard lighter and the only preliminary action necessary is with the same digit, generally the thumb, which the user uses to act on the thumb wheels 9 or 109.

This security system is also inviolable because it does not require the addition of a device to a standard lighter which can be retracted, but it encompasses a new concept for a lighter.

Furthermore, the elastic means returning the lever and the spark wheel to their position of rest are notably springs which are already used in a standard lighter. In fact, use is made of the spring which presses the pyrophoric flint towards the spark wheel and the return spring returning the lever to its position of rest to reclose the valve. Naturally, the invention is not limited to the non-limiting exemplary embodiments of the invention described above, but includes all variations.

Thus, for example, it is possible to mix the different variations described above, adapting, for example, a lever such as shown in FIG. 9 in the lighter of FIGS. 11 to 13.

The shape of the openings in the plates of the body of the lighter or the brackets of the lever or of the sheath could all be different. Even so, in the last embodiment described, it is not necessary to have openings in the plates of the body of the lighter for the ends of the axis of the spark wheel. The 'V' shape described is a preferred embodiment because it permits three states: a rear unstable position rendering all ignition impossible, a front unstable position permitting ignition, and a stable middle position permitting the movement into one of the two other positions when the spark wheel is rotated.

I claim:

1. A gas lighter of the type comprising a lighter body, a reservoir for containing a liquefied petroleum gas, a valve mounted on the reservoir permitting gas to leave the reservoir, an ignition system comprising a pyrophoric flint co-operating with a spark wheel and a spring maintaining the flint against the spark wheel, the spark wheel being rotatably operated by at least one thumb wheel mounted co-axially with the spark wheel, and also a system of opening and closing for the release of gas comprising a lever pivotally mounted on an axis essentially parallel to the axis of rotation of the spark wheel and co-operating with the valve mounted on the reservoir, characterised in that the axis of the lever is mounted movably with respect to the body of the lighter between an active position permitting the operation of the valve mounted on the reservoir and a rest position in which action on the lever does not permit operation of the valve, in that the spark wheel is mounted in such a way that it can be displaced with respect to the body of the lighter, and that it operates the lever in its movement, such that when the spark wheel is pressed it causes the lever to move from the rest position to the active position, and in that elastic means act on the lever and/or on the spark wheel to return them to a position of rest in which the lever does not act on the valve.

2. A gas lighter according to claim 1, characterised in that the lever comprises lateral spindles defining its pivoting axis and in that the body of the lighter comprises two oblong openings, each receiving a spindle of the pivoting lever.

3. A gas lighter according to claim 2, characterised in that the oblong openings are 'V' shaped, the point of the 'V' being located next to the spark wheel and in that the spindles of the pivoting lever are located at the level of the point of the 'V' in the rest position of the lever, and at the level of the end of the branch of the 'V' located next to the valve in the active position of the lever.

4. A gas lighter according to claim 1, characterised in that the pivoting lever comprises an abutting face which acts against a counter Application abutting face integral with the body of the lighter when the lever is in its rest position, thus preventing pivoting of the lever, and which is in a non-effective position with respect to the counter-abutting face in the active position of the lever, thus permitting pivoting of the lever and operation of the valve.

5. A gas lighter according to claim 1, characterised in that the valve comprises a shoulder on which the lever acts to open the valve letting the gas escape from the reservoir and on the side of the valve the lever comprises two openings of different diameters, the opening with the largest diameter is situated in front of the shoulder when the lever is in the rest position and being such that the shoulder passes through this opening, and the opening with the smaller diameter is situated in front of the shoulder when the lever is in the active position and being such that the shoulder is not able to pass through this small opening.

6. A gas lighter according to claim 1, characterised in that the pivoting lever comprises two wings essentially parallel to the axis of the body of the lighter, between which the spark wheel is mounted.

7. A gas lighter according to claim 1, characterised in that the ignition system comprises a pyrophoric flint and a spark wheel mounted in a sheath, comprising a tubular part surrounding the flint, and two wings between which is mounted the spark wheel at one of the ends of the tubular part, in that the sheath is placed in a housing arranged in the body of the lighter in such a way that the sheath can pivot in the interior of this housing, and in that the sheath passes through an opening formed in the pivoting lever in such a way that the ignition system moves in its housing, this movement being transmitted to the pivoting lever.

* * * * *